US005383608A

United States Patent [19]

Dahlqvist et al.

[11] Patent Number: 5,383,608

[45] Date of Patent: Jan. 24, 1995

[54] TWIN CONICAL REFINER WITH DUAL RIBBON FEEDERS

[75] Inventors: Karl Thore G. Dahlqvist, Norrkoping, Sweden; Franz Haider, Graz, Austria; Gregory R. Kohler, Williamsport, Pa.; Josef Krasser, Rein, Austria; William F. Lahner, III, Lewisburg, Pa.; Alfred Lang, Graz-Stattegc, Austria; Wilhelm Mausser, Graz, Austria; Heinrich F. Munster, Vienna, Austria; Josef Muser, Neu-Setersberg, Austria; Ronald L. Musselman, Lewisburg, Pa.; Walter Writzl, Graz, Austria

[73] Assignee: Andritz Sprout-Bauer, Inc., Muncy, Pa.

[21] Appl. No.: 34,154

[22] Filed: Mar. 22, 1993

[51] Int. Cl.[6] ..... B02C 7/06; B02C 23/02

[52] U.S. Cl. ..... 241/16; 241/247; 241/261.1

[58] Field of Search ..... 241/16, 247, 261.1, 241/246, 17, 21

[56] References Cited

U.S. PATENT DOCUMENTS

| | | | |
|---|---|---|---|
| 3,427,690 | 2/1969 | Haug . | |
| 3,893,631 | 7/1975 | Fisher et al. | 241/247 X |
| 3,984,057 | 10/1976 | Pilao . | |
| 4,253,613 | 3/1981 | Reinhall | 241/16 |
| 4,283,016 | 8/1981 | Reinhall . | |
| 4,401,280 | 8/1983 | Reinhall | 241/247 |
| 4,610,400 | 9/1986 | Sjöbom . | |
| 4,872,617 | 10/1989 | Forsman | 241/247 |
| 4,908,101 | 3/1990 | Frisk et al. | 241/247 X |
| 5,076,892 | 12/1991 | Fisher et al. | 162/23 X |
| 5,127,591 | 7/1992 | Bernhard et al. | 241/261.1 X |

FOREIGN PATENT DOCUMENTS

| | | |
|---|---|---|
| 1152370 | 10/1980 | Canada . |
| 2083375A | 8/1981 | United Kingdom . |

*Primary Examiner*—Douglas D. Watts

*Attorney, Agent, or Firm*—Chilton, Alix & Van Kirk

[57] ABSTRACT

Apparatus and method for the mechanical refining of high consistency lignocellulosic feed material in a frustroconical refining zone, by facilitating the backflow of steam generated in the refining zone through the upstream feed zone which, despite the backflow of steam, imparts outward force on the feed material sufficient for the material to enter the refining zone and pass therethrough, without blockage or flow interruption. This is accomplished by providing, immediately upstream of the frustroconical refining zone (46), a hybrid feed/-grinding zone (104), which acts on the wood chips with relatively high refining intensity at low refining power, so as to reduce the size of the material and outwardly convey the material by centrifugal force into the frustroconical refining zone against the backflowing steam, but without generating steam in the hybrid zone. The hybrid zone receives chips from a feed screw (84) which preferably rotates at the same speed as the rotor (20) portion of the frustroconical refining zone and hybrid zone. The feed screw is shaped (e.g., as a ribbon screw) so that the chip material is easily "handed-off" to the entry of the hybrid zone, while establishing an open channel (166) between the chip material and the shaft of the feed screw, for conveying backflowing steam away from the hybrid zone. First pressure control means (136) are provided in fluid communication with the backflow steam channel, for removing the backflowing steam from the refiner at a controlled pressure, thereby controlling the retention time of the material in the frustroconical refining zone (146).

42 Claims, 2 Drawing Sheets

TWIN CONICAL REFINER WITH DUAL RIBBON FEEDERS

BACKGROUND OF THE INVENTION

The present invention relates to the refining of lignocellulosic material, and more particularly, to so-called high consistency pulp refining.

The technology associated with the refining of cellulosic material for paper making purposes, has been developed to a high degree of effectiveness in so-called "flat disc" refiners. In the past, the performance of such machines has been improved by increasing the disc diameter and speed of rotation. Increase in size has, however, reached practical limits with respect to the material integrity of the disc, and the adverse effect of high centrifical forces on the retention time of material as it passes radially outward along the disc. In particular, the high centrifical forces acting on the steam generated during high consistency refining imparts such high radial velocities, as to cause the steam to carry the pulp material out of the grinding space before full refining action has been completed.

Various efforts have been made in recent decades to overcome some of these problems. Developments represented by U.S. Pat. Nos. 4,090,672; 4,238,016; and 4,253,613 provide a combination of a radially extending and inclined refining zones, the latter having a retaining influence on the steam, thereby inhibiting the "blow-out" effect. In other words, substantially the same total refining gap length can be achieved without blow-out, relative to flat disc refiners.

U.S. Pat. No. 4,253,613 discloses a single conical refining zone following a single radial refining zone, which receives wood chips from a single feed screw of solid flight construction. Several deficiencies are inherent to this configuration. Having a radial, or flat refining zone prior to the conical refining zone impedes the free flow of steam backward from the conical refining zone, due to the forward flowing steam generated in the flat refining zone. This forces all the steam in the conical zone to flow forward. The flat zone acts as a pressure seal to prevent steam generated in the conical zone from backflowing into the flat zone. As a result, retention time of the material in the conical zone cannot be controlled by direct adjustment of the steam pressure difference across the conical zone (i.e., by steam flow valves). Because the nature of the fiber development in the conical zone is so dependent on retention time, fine control of retention time would be advantageous. Yet, the machine disclosed in the '613 experiences the inherent reduction in the effectiveness of mechanical conveying along the conical zone, without the ability to control conveyance via steam flow control. Some of the steam generated in the flat zone of the '613 refiner does flow backward. The solid flighted feeding screw does not provide openings for the backflowing of steam while conveying the material to be fed forward. This configuration can result in the material feed being interrupted by the steam flow and cause instability of the refining operation, thereby reducing production rates and pulp quality.

Another high consistency conical refiner is disclosed by U.S. Pat. No. 4,401,280, where the material is fed from a solid flighted feed screw which is cantilevered and operated by a separate drive mechanism. The feed screw feeds into a radial zone consisting of enclosed pockets in the rotating member from which the material is fed into the conical refining zone. The cantilevered feed screw arrangement with a separate drive arrangement operates at a lower rotation speed than the rotating disc of the refining zone due to mechanical and critical speed limitations. This results in lower centrifugal force in the feeder, limiting steam and fiber separation. The limitations of the solid feeder flight arrangement as indicated above with respect to U.S. Pat. No. 4,253,613, are also present. The substantially radial feed pockets have both walls rotating with the disc and therefore will provide no breaking action to chips that are being fed since there are no relative rotating bars to provide the breaking. This arrangement will feed the chips directly to the conical refining zone and require the chip breaking to occur there. This results in a substantial reduction in the fiber refining area in the conical zone. This would also potentially limit the machine to applications where chips must be refined into a coarse fiber prior to delivery into the refiner machine. Transfer of material to be refined from the feed screw to the rotating feed pockets is also difficult because the rotating pockets and feed screw are not physically attached. Since the conical refining zone gap is adjusted by moving the rotating disc, space must be provided between the two members. This increases the possibility that backflowing steam will interrupt the continuous feed of material.

The concept of a two zone, high consistency conical refiner has been disclosed in U.S. Pat. No. 5,127,591. This patent discloses a single material feeding location at the center and transverse to the rotation axis of the machine. The conical refining zones extend with the major diameter away from the center and receive a predominantly axial feed of material. The deficiencies in this concept arise from the predominantly axial feeding into the conical refiner zones, which does not allow centrifugal force to feed the material into the refining zone, particularly against the backflowing steam generated in the conical zones. Therefore, in order to feed fibrous material into the conical refining zones, all of the generated steam must flow forward. Flowing all the steam forward requires a higher pressure at the grinding space inlet, than at any point along the conical plate surface or the discharge. Since steam pressures as high as 50 to 100 psi above the machine operating pressure can be generated in the refining zone, the complete inlet area of the machine back to the pressure seal where chips are fed into the refiner must be maintained at this high pressure. This high pressure and resulting high temperature tends to darken the fibrous material, resulting in unacceptable darkening of the final sheet of paper to be produced. Also, forcing all the steam to flow forward through the conical refining zone reduces the retention time of the material in the zone, thereby increasing the intensity of the refining action. This limits the range of pulp characteristics that can be achieved in a given refiner. The high inlet pressure required to feed all the steam forward and convey the material to be refined into the refining zone also requires that the inlet zone of the refiner and the equipment feeding the refiner, be capable of withstanding this higher pressure. Thus heavier construction and increased manufacturing cost result.

SUMMARY OF THE INVENTION

It is, accordingly, an object of the present invention to provide an improved apparatus and method for the mechanical refining of high consistency lignocellulosic feed material in a frustroconical refining zone, by facilitating the backflow of steam generated in the refining zone through the upstream feed zone which, despite the backflow of steam, imparts outward force on the feed material sufficient for the material to enter the refining zone and pass therethrough, without blockage or flow interruption.

It is another object of the invention that the refining characteristics in the frustroconical refining zone, be adjustable, by independently controlling the relationship of the machine outlet pressure, and the backflow steam extraction pressure, thereby adjusting the steam profile in the refining zone.

This is accomplished in accordance with the invention, by providing, immediately upstream of the frustroconical refining zone, a hybrid feed/grinding zone, which acts on the wood chips with relatively high refining intensity at low refining power, so as to reduce the size of the material and outwardly convey the material by centrifugal force into the frustroconical refining zone against the backflowing steam, but without generating steam in the hybrid zone. The hybrid zone receives chips from a feed screw which preferably rotates at the same speed as the rotor portion of the frustroconical refining zone and hybrid zone. The feed screw is shaped (e.g., as a ribbon screw) so that the chip material is easily "handed-off" to the entry of the hybrid zone, while establishing an open channel between the chip material and the shaft of the feed screw, for conveying backflowing steam away from the hybrid zone.

Preferably, first pressure control means are provided in fluid communication with the backflow steam channel, for removing the backflowing steam from the refiner at a controlled pressure. Second pressure control means are provided for controlling the pressure at which the mixture of refined pulp and steam, emerges from the frustroconical refining zone and is discharged from the refiner casing. The chip material is fed to the refiner at a predetermined pressure, which may also be controlled. The frustroconical refining zone and the hybrid zone are defined by bars, grooves and gaps, which in the refining zone act on the material with relatively low refining intensity and high refining power, thereby establishing a steam pressure profile. This pressure profile defines the pressure acting on the material flowing from the hybrid zone into the frustroconical refining zone, the pressure at which the steam from the refining zone backflows into the hybrid zone, and the pressure at which the pulp and steam mixture emerges in the forward flow direction from the frustroconical gap at the apex of the refiner rotor.

Preferably, the hybrid zone has juxtaposed bar surfaces defining a gap which curves such that at the transition from the hybrid zone to the frustroconical refining zone, the gap in the hybrid zone is within about 20 degrees, and preferably within about 10 degrees, of the angle formed between the frustroconical refining gap and the rotation axis. In the preferred embodiment, the angle formed by the frustroconical refining zone relative to the axis, is in the range of 20–30 degrees, with 25 degrees being especially desirable. Under these circumstances, the hybrid zone gap angle at the transition would be less than about 45 degrees, whereas the hybrid gap angle near the entrance to the hybrid zone, would be less than about 80 degrees. It is especially desirable that the groove profile angle in the stationary plate at the transition into the frustroconical refining zone, more closely approach the refining zone gap angle, e.g., closer to 25 degrees than to 45 degrees.

The hybrid zone not only conveys material into the frustroconical refining zone while accommodating a backflow of steam from the refining zone, but the hybrid zone also reduces the size of the chips at low power, high intensity. The gap width is an important determinant of the relative intensity/power as between the frustroconical refining zone and the hybrid zone. The control of refining characteristics can also be achieved by a third control means, for adjusting the difference in the refining power imposed on the material in the frustroconical and radial refining zones, by adjusting at least one of the frustroconical refining gap and the radial refining gap. This adjustment can be made with or without the use or actuation of the first and second pressure control means. In general, the feed gap is greater than the refining zone gap, by a factor of at least five. For example, when the refining zone gap is nominally zero, the hybrid zone gap can be approximately 0.160 inch. When the refining zone gap during normal operation is in the range of 0.020–0.050 inch, the hybrid zone gap would be in the range of 0.200–0.350 inch.

The invention is preferably implemented in a machine having substantially tubular left and right shaft housings disposed about a common longitudinal axis, a rotor housing situated between and connected to the left and right shaft housings, and a twin conical rotor situated within the rotor housing for rotation about the longitudinal axis. The rotor preferably has a major diameter which lies in a plane of symmetry extending perpendicularly to the axis midway between axially spaced apart left and right ends, with left and right frustroconical refining zones defined between the left end and the major diameter of the rotor, and the right end and the major diameter of the rotor. In this way, the material in the left refining zone and the material in the right refining zone flow as a mixture of pulp and steam toward the major diameter.

Preferably, the rotor assembly comprises two substantially identical frustroconical members, which are generally bowl-shaped and are joined together at confronting annular faces to form a rotor shell that has an enclosed cavity, the shell and cavity being symmetric about the rotation axis and about a vertical plane that passes in parallel between the annular faces.

Thus, the preferred method for the high consistency mechanical refining of cellulosic material in a refining zone defined between a rotor surface and a stator surface, in accordance with the present invention, comprises the steps of driving left and right shaft segments within substantially tubular left and right shaft housings disposed about a common longitudinal axis, so as to spin a twin conical rotor connected between the shaft segments and situated within a rotor housing which is connected between the left and right shaft housings. The rotor has a major diameter which lies in a plane of symmetry extending perpendicularly to the axis midway between axially spaced apart left and right rotor ends. Feed material is conveyed axially inwardly in a first feed zone, along the inner wall of each shaft housing, to the rotor. The feed material is conveyed through a second feed zone at each end of the rotor. The second feed zone performs several functions, and may alternatively be referred to as the hybrid zone. The hybrid zone is defined by juxtaposed bars and grooves on opposed rotating and stationary plates, which define a hybrid zone gap which narrows from the first feed zone to the refining zone. Each hybrid zone receives feed material from the first feed zone, breaks down the size of the material in the hybrid gap without generation of steam, and advances the size-reduced material into the refining zones under the influence of the centrifugal force of the spinning rotor. The material then passes through the refining zone, where it is defribrated with the release of steam. The material in the left refining zone and the material in the right refining zone flow toward the major diameter of the rotor, where the mixture of refined pulp and steam emerging from the refining zone at the major diameter are captured in a casing and discharged from the refiner.

The conical refining zones, the angled or curved hybrid zone, and a ribbon screw feeder rotating at the shaft and disc speed, all provide for the unencumbered backward flow of steam from the conical refining zone. This feature allows varying the inlet and discharge pressures of the machine with separate controls. Increasing the refining zone inlet pressure higher than the discharge pressure reduces the retention time of the pulp in the conical refining zone, thereby increasing the refining intensity by providing more energy input for each bar impact upon the pulp. This results in pulp with shorter fiber length and improved optical and printing properties. By running the machine with the discharge pressure higher than the inlet pressure, the retention time of the pulp in the conical refining zone is increased, thereby reducing the intensity of the refining action, resulting in pulp with improved strength properties. Basically, this steam flow and pressure flexibility allows the steam pressure differential across the refining zone to be used as a means to control the particular pulp properties produced by the machine.

The opposed conical refining zones allow the substantial thrust generated in the refining zones by the grinding action and the associated high steam pressures, to be balanced in the machine, thus eliminating the need for a large thrust bearing as required in a machine with only a single grinding zone where all of the thrust generated must be opposed by the bearing in the refiner. Rotating the ribbon feed screws at the same speed as the rotating members allows a direct hand off of material from the feedscrew to the hybrid feed zone, limiting the opportunity for the backflowing steam to interrupt the material feed and cause machine instability.

DESCRIPTION OF THE PREFERRED EMBODIMENT

Figure 1:
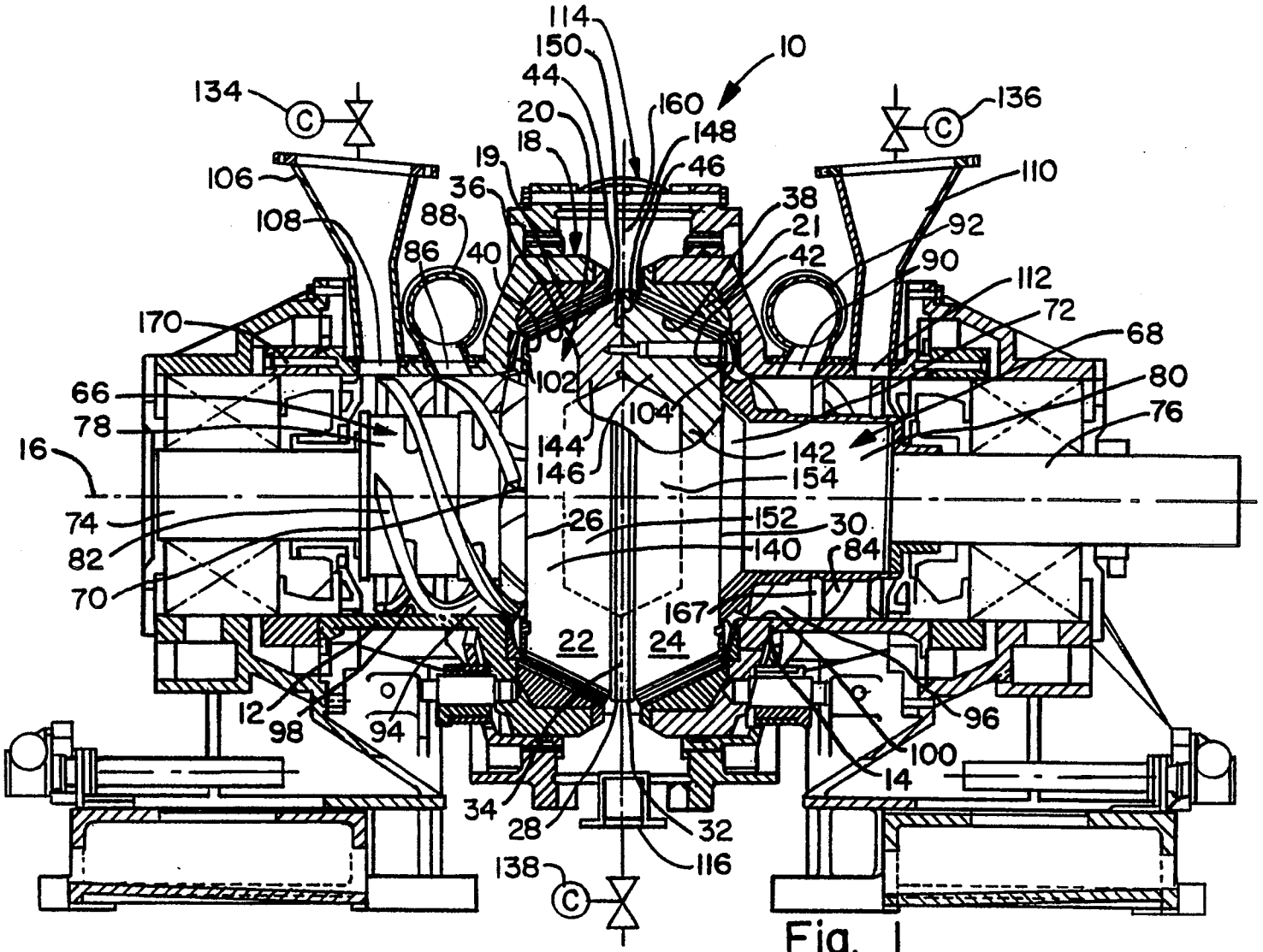

FIG. 1 shows a high consistency twin conical refiner unit 10 in accordance with the preferred embodiment of the present invention. The refiner 10 in overall configuration, has substantially tubular left and right shaft housings 12,14, disposed about a common longitudinal axis 16. A rotor housing 18 is situated between, and integral with or connected to, the left and right shaft housings 12,14. A twin conical rotor 20 is situated within the rotor housing 18, for rotation about the longitudinal axis 16. Material to be refined is conveyed axially inward through shaft housings 12, 14 to the rotor 20.

The rotor 20 comprises left and right conical portions 22, 24, each portion having a minor diameter 26, 30, and a major diameter 28, 32. It should be appreciated that the overall shape of each portion is actually a truncated cone, i.e., frustroconical. The minor diameter ends 26, 30 can be considered as defining a circular corner or edge of the inclined, conical surfaces 36, 38. The major diameter ends 28, 32 are substantially congruent, and thereby define the rotor apex 34. The apex is substantially the same diameter as the end faces at the major diameters 28, 32 of the respective conical portions 22, 24. The rotor thus has left and right inclined surfaces 36, 38 extending toward each other obliquely to the axis 16, from the minor diameter ends 26, 30 toward the major diameter ends 28, 32, respectively. The rotor includes left and right base portions 40, 42 extending from the minor diameter ends 26, 30 towards axis 16, at an included angle of at least about 45 degrees relative to the axis.

Figure 2:
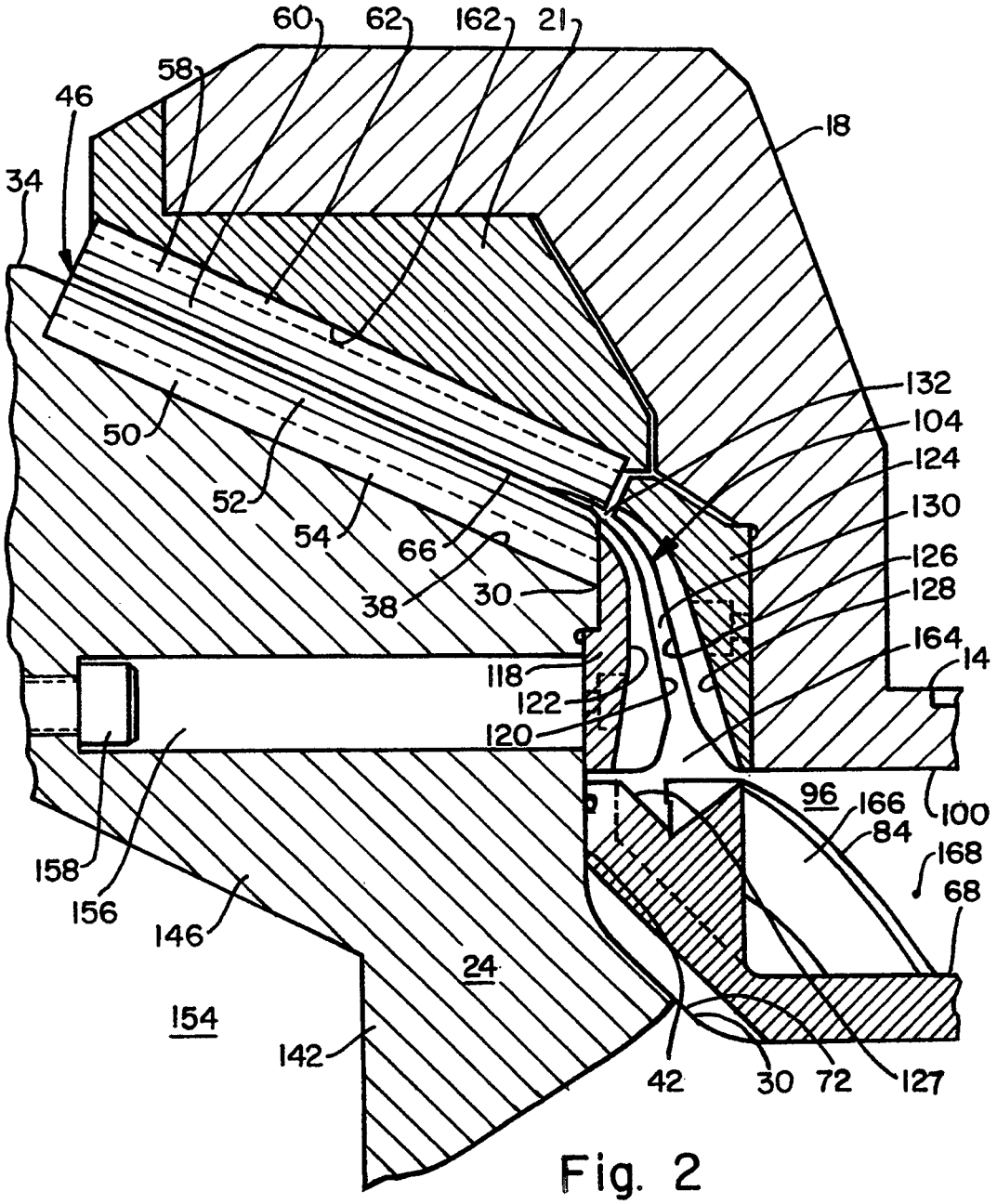

FIG. 2 shows in detail, features of the right side of the refiner 10, but it should be understood that the left side has a mirror image correspondence. Referring now to both FIGS. 1 and 2, the rotor housing 18 preferably includes substantially annular left and right plate holders 19, 21 which are externally shouldered to fit with mating shoulders on the interior of the rotor housing 18. These plate holders have inclined surfaces 162 which oppose the inclined surfaces 162, 38 of the rotor. The inclined surfaces 21, 38 carry grinding plates 58, 50 which define a frustroconical refining zone 44, 46. Similarly, stationary plates 124 carried by the rotor housing 18 in opposition to another set of plates 118 carried at the base 42 of the rotor 20, define a centrifugal feed zone 104 from which material to be refined is introduced at the minor diameter end 30 into the conical refining zones 46. Another axial feed zone 96 is situated upstream of the centrifugal feed zone 104. These zones will hereinafter be referred to as first feed zone 96, second feed zone 104, and refining zone 46.

With specific reference now to FIG. 2, the rotating refiner plates 48,50 have bars 52 and grooves 54 carried by the inclined surface 38 of the rotor. Stationary refining plates 56, 58 have bars 60 and grooves 62 carried by the rotor housing 18 (or equivalently the holder plates 21), the refiner plates 50, 58 being juxtaposed to define a frustroconical refining gap 66 along which cellulosic material is defibrated with the release of steam. It should be appreciated that, preferably, the left and right refining zones 44, 46 discharge into a common region within the casing at the apex 34.

In the second feed zone 104, rotating feed plates 118 have bars 120 and grooves 122 carried by the base portion 42 of the rotor. Stationary feed plates 124 have bars 126 and grooves 128 carried by the rotor housing or, equivalently, holder plates within the rotor housing. The plates 118, 124 are juxtaposed to define a feed gap 130 which preferably narrows from the discharge at 164 of the first feed zone 96, to the refining zone 46. The material entering the second feed zone 104 at 164, is in the form of high consistency wood chips. The overall angular orientation of the feed gap 130 is preferably at least about 10 degrees off vertical toward apex 34, thereby forming an acute angle with the axis 16. Under the influence of centrifugal force imparted by the rotation of the feed plate 118 as carried by the rotor 20, the feed material is advanced toward the refining zone 46, while being reduced in size by interaction with the opposed bars 120, 126.

The refining zone 46 preferably is at an acute angle of less than 45 degrees relative to the axis and desirably within the range of 20–30, preferably 25 degrees. The wood chips enter the second feed zone 104, at an angle that is nearly vertical, and must be redirected through the second feed zone so as to enter the refining zone 46 with sufficient momentum parallel to the refining gap 66, to continue flowing outwardly through the refining zone 46. This is not an easy objective to accomplish, for two reasons. First, the feed gap 130 is relatively close to the rotation axis 16, and it is angled relative to the rotation axis. These factors do not take full advantage of the potentially available centrifugal force that is available in prior art, flat discs, where the radial portion of the inner refining zone is of substantially the same length as the angled portion of the outer refining zone (see for example, U.S. Pat. No. 4,253,613). Secondly, the generation of steam in the conical refining zone 46, has a backflow component which resists the introduction of material at the transition 132 between zones 104 and 46.

In a significant advantage provided by the present invention, the second feed zone 104 reduces the chip size in a pre-refining action at a relatively high intensity, but with insufficient power to generate steam. This means that no net pressure increase is generated within the feed zone 104, which would impede the entry and advance of chips through the gap 130. Rather, this permits the backflow steam from refining gap 66 to flow with relative ease through the second feed zone 104, toward the first feed zone 96. This backflow is facilitated by the groove profiles represented at 122, 128 which provide a diffuser effect in the backflow direction, at the same time that the bar surfaces 122, 126 are providing a chopping and funelling effect in the gap 130, to the forward flowing feed material. Whereas the backflowing steam would likely flow across the full cross section of the second feed zone 104, it is believed that the chips, due to centrifical force, would preferentially accumulate and advanced along the stationary plate 124, and the backflowing steam would preferentially follow the groove profile 122 on the plate 118. Near the entrance 164 to the second feed zone 104, the groove profiles 122 on the rotating feed plate 118, can have a reversed curvature, i.e., past vertical.

Preferably, the gap 130 in the second feed zone 104, curves such that at 132, the acute angle of the gap relative to the axis, is within 30 degrees, and preferably within 20 degrees, of the angle formed by the refining gap 66 with the axis. The entrance of the refining gap 66 may also be slightly tapered to complete the transition angle. Thus, the angle of gap 130 preferably varies from about 80 degrees to about 50 degrees, between 164 and 132.

At the transition 132, the angle of groove 122 would be about 45 degrees, the angles of the opposed surfaces of bars 120, 126, would each be at an angle of about 40 degrees, and the groove 128 would be at an angle of approximately 25 degrees, all of these angles being measured consistently with the 25 degree angle of the refining gap 66 i.e., as an acute angle relative to the refiner axis 16.

The length of the refining gap 66 is preferably at least 50% greater than the length of the feed gap 130. This ratio provides a relatively long refining zone 46 while avoiding an excessively large maximum diameter for each conical portion, with beneficial consequences with respect to rotor mass, and motor power. With the present invention, a relatively short feed zone 104 can prerefine feed material without generating steam, and impart sufficient centrifugal force to feed a refining zone 46 which is long enough to achieve high refining quality but at reduced maximum rotor diameter. Moreover, as will be discussed more fully below, the deliberate avoidance of steam generation in the feed zone 104, permits positive control of the steam profile in the refining zone 46, and thus control of fiber quality emerging from the refining zone.

This steam profile control can best be understood with reference to FIGS. 1 and 2. Left and right shaft segments 66, 68 are situated coaxially within the left and right shaft housings 12, 14 respectively. Each shaft segment has an inner end 70, 72 connected to the base portion 40, 42 of a rotor conical portion 22, 24, an outer end 74, 76 journalled for rotation within a shaft housing, and a shank 78, 80 extending between the inner and outer ends of the shaft segment. A ribbon feed screw 82, 84 is secured to the shank 78, 80 of each shaft segment for co-rotation therewith. This means that the shank 78, 80, the feed screw 82, 84, and the rotor 20, all spin at the same rate, e.g., preferably 1800 rpm. The ribbon screw arrangement is similar to that described in U.S. Pat. No. 3,441,227, the disclosure of which is hereby incorporated by reference. Such a ribbon screw has flights 166 which are radially spaced from the shank 78, 80 and supported by bars 167 or the like extending radially between the shank and the flights.

Radially outward from approximately the axial center of the ribbon feed screw 82, 84, the shaft housing has penetrations 86, 90 through which chips are supplied to the feed screw 82, 84, under pressure. This is typically accomplished in a known manner, through the use of plug feed screws 88, 92 or the like. The feed screws 82, 84 advance the feed material axially through first feed zone 94, 96 along the inside wall 98, 100 of the shaft housing 12, 14 to the base portions 40, 42 of the rotor. Preferably, the base portion 42 includes a plurality of spaced apart blades 127, located substantially at the juncture of the inner end 70, 72 of the shaft segment with the rotor 20, and below entrance 164 to the second feed zone 104. The flight 166 of the ribbon screw 84 extends axially to a position substantially below the entrance 164 to the second feed zone 104. The centrifugal force acting on the feed material in the flight 166 flings the feed material substantially radially into the entrance 164, as the feed material enters the rotor housing 18. The blades 126 at the base 42 of the rotor help fling feed material which may not have initially taken a radial path into the entrance 164, back into the entrance. Moreover, refined or size-reduced material that may be entrained in the backflowing steam from the feed zone 104, will be redirected towards the entrance 164.

The substantially conical slope of the base 42 where the blades are attached to the rotor at 72, provides an open flow path for the backflowing steam to find its way to the outer surface of the shaft segment 68. It can be appreciated that as shown in FIG. 2, the centrifical force imparted by the ribbon screw causes the feed material within the shaft housing 14 to preferentially accumulate along the inside surface 100, thereby opening a channel generally shown at 168, through which the backflowing steam encounters relatively little resistance while flowing in a direction axially away from the rotor 20.

A second set of penetrations 108, 112 in the shaft housing 12, 14 provides a means for the backflowing steam to enter exhaust conduits 106, 110 for withdrawing the backflowing steam from the ribbon screws 82, 84 and the refiner unit 10. These steam exhaust conduits 106, 110 are preferably situated axially outwardly from the chip feeders 88, 92. Thus, the steam backflowing within the feed screw 82, 84 can flow unimpeded radially outwardly towards the penetrations 108, 112, without blockage by the chip feed flow entering the housing at 86, 90.

The forward flowing steam contains refined fibers as it emerges from the refining zone 46 at apex 34, where it is captured within the casing 114 surrounding the rotor housing 18, and discharged through a nozzle 116 or the like at super-atmospheric pressure, for further processing downstream of the refiner unit 10.

A significant advantage of the preferred embodiment of the present invention can be achieved as shown in FIG. 1 by control means such as control valves 134, 136 associated with the backflow discharge conduits 106, 110, for increasing the backflow steam pressure above atmospheric. Conventionally, the casing discharge nozzle 116 has a discharge pressure control valve 138 associated therewith. With the control valves shown in FIG. 1, the operator can independently adjust the refiner discharge pressure at 138, and the steam backflow pressure at 134, 136. Since, preferably, steam is generated within the refiner only along the gap 66 of the inclined refining zone 44, 46 changes in the control valves at 134, 136, 138 will directly affect the steam pressures at the entrance and exits of the refining gap 66. This will, in turn affect the steam pressure profile and the retention time of the pulp in the refining zone 46.

Retention time is one significant factor contributing to fiber quality in a high consistency thermal mechanical pulp refiner of the type to which the present invention relates. Increasing the inlet pressure at 132 to a higher value than the discharge pressure at 34, reduces retention time and increases refining intensity by providing more energy input for each bar impact on the pulp. Increasing the discharge pressure at 34 above the inlet pressure at 132, retention time is increased, with a reduction in intensity.

It should be appreciated that the refining intensity control available with the present invention depends in large part on the deliberate avoidance of significant steam generation in the second feed zone 104. A single steam generation profile, i.e., only in zone 46, simplifies the control of retention time and related refining parameters in zone 46, merely by adjusting the relative pressures at the valves 134, 136, 138. The second feed zone 104 reduces the size of the feed chips by grinding, but without so-called "fiber development". The grinding is performed in a relatively short gap 130, with sufficient intensity and size reduction, to permit refining of the material with fiber development including steam generation, very soon after the material enters refining zone 46. But, the material in gap 130 should not be developed prematurely, i.e., grinding should be limited so as not to generate steam in zone 104. Useful control of the refining quality by steam pressure control, would be much more complex if attempted in a refiner having two refining zones with two interacting steam generation profiles.

Preferred differences between the second feed zone 104 and the refining zone 46, can be expressed in other terms, as well. Whereas the feed zone 104 reduces chip size and fiber size by the imposition of high intensity at relatively low power, the refining action in zone 46 is at low intensity, and high power. This is accomplished in part by differences in the bar and groove patterns and gap width, of the zones 46 and 104.

If the plates 50, 58 are adjusted so that the bars 52, 60 touch, defining a "zero" gap 66, a gap of at least 0.160 inch remains between the top surfaces of the bars 120, 126 in the feeder zone 104. Therefore, if the refining gap 66 ranges during normal operation from about 0.02–0.50 inch, the feeder gap 130 would range from about 0.200–0.350 inch. The minimum gap 130 in all conditions, is at least five times the average gap 66. From this difference in gaps, it can be seen that the action of the bars and grooves in zone 104 is to break chips into particles of a size that can pass between the two opposed bar surfaces 120, 126 and not be contacted, resulting in a "toothpick" type material, whereas the refining zone 46 with a significantly tighter plate clearance 66, acts directly upon the fibers themselves to break them apart and develop the fiber surface. Thus, the power applied in the two zones would be primarily dependent on the operating gap clearance between the bars.

It should also be appreciated that, unlike in true disc refiners, the axial movement of the rotating plates relative to the stationary plates changes the gap 66, 130 non-uniformly. Given the general desired configuration shown in FIG. 2, a slight adjustment in the axial relationship of the rotor 20 relative to the rotor casing 18, would have a less profound effect on the refining gap 66, than on the feed gap 130. This provides another means for controlling refiner quality. This can be accomplished for example by a hydraulic piston or other adjustment member 170, by which the rotor housing 18 can be displaced axially relative to the shaft and its associated rotor 20. In the embodiment shown in FIG. 1, each shaft housing 12, 14 is integral with, or fixed to, one half of the rotor housing 18, such that axial displacement of a shaft housing also displaces the corresponding half of the rotor housing, which in turn displaces the plate holder 19, 21 and the stationary plate 58, toward the rotating plate 50. The stationary feed plate 124, which is also supported by the rotor housing, likewise moves axially toward the rotating feed plate 118.

The difference in the two zones with respect to refining intensity, arises from having relatively few bars in zone 104, coupled with the relatively high centrifugal force, resulting in relatively few bar impacts and a very short retention time of the material. Thus, the energy applied per bar impact, which is the measure of intensity, is very high. In the refining zone 46, a relatively large number of bars and an increase in retention time due to the reduction in the centrifugal force component in the direction of forward material flow, produces a relatively lower intensity, or energy per bar impact.

The amount of steam generated is essentially purely a function of the power applied in each zone. Therefore the high power in the refining zone 46 will account for virtually all the steam generation in the machine. In general, when the rotor plates or stationary plates are viewed along the rotation axis, so that the plate surfaces appear circular, the number of bars per radian from, for example, the 12:00 o'clock position, would be at least four times as great in the plates associated with the refining zone 46, as with the plates associated with the feed zone 104. The grooves 62 in the stator plate 58 of the refining zone 46, can have so-called "dams" to retard solid flow, especially at the outer half of zone 46, whereas the grooves 54 of the rotating plate 50 can be free of dams to facilitate steam flow.

The following table summarizes the differences between six parameters, as would generally be found between the refining zone 46 and the hybrid zone 104, in a refiner which embodies the preferred features of the invention.

PREFERRED RELATIONSHIP BETWEEN REFINING ZONE (46) AND HYBRID ZONE (104)

| PARAMETER | REFINING ZONE (46) | HYBRID ZONE (104) |
|---|---|---|
| Intensity | I (HP days/ton) | I' >50 I |
| Power | P (HP) | P' <0.1 P |
| Gap Length | L (inch) | L' <0.66 L |
| Gap Width | W (inch) | W' >5 W |
| Bar Density | B (bars per radian) | B' <0.25 B |
| Retention Time | T (seconds) | T' <0.03 T |

Intensity = Energy per Bar impact on the material in the zone; normally defined as Power applied per ton of material (Retention Time) (Bar crossing frequency).
Power = Refiner torque × Speed of rotation, where Refiner torque = (Normal force × Mean radius) and Normal Force is the squeezing force of the stationary plates multiplied by the friction coefficient.
Gap Width = Shortest distance from a point on the surface of one bar, to the surface of opposed bar.

In view of the multiple functions to be performed in the zone 104, it may more accurately be considered a hybrid zone, rather than a feed zone. Feeding is, of course, a critical function, because the material must be redirected while under the influence of centrifugal force, to enter the refining zone 46 at an angle that is less than about 45 degrees relative to the rotation axis. The wood chips from the screw feeder, must in addition, be reduced in size while they are conveyed toward the refining zone 46, but not to the extent that steam is generated in zone 104. Finally, the zone 104 must be adapted to accommodate the backflow of steam from the refining zone 46, without undermining the other two functions. In order to accomplish these functions, the transition at 132 must neither seal off the backflow of steam from refining zone 46, nor significantly throttle the flow of size-reduced material from zone 104 to zone 46. Thus, no obstructions, such as dams in the grooves 54, 62, 122, 128, should be present near the transition 132.

When viewed as a method, the present invention comprises the steps of driving left and right shaft segments 66, 68 within substantially tubular left and right shaft housings 12, 14 disposed about a common longitudinal axis 16, so as to spin a rotor 20 connected between the shaft segments and situated within a rotor housing 18 connected between the left and right shaft housings. The rotor has a major diameter or apex 34 which lies in the plane of symmetry 160 extending perpendicularly to the axis midway between the axially spaced apart left and right rotor ends 26, 30. Feed material is conveyed axially inwardly in a pair of first feed zones 94, 96 along the inner walls 98, 100 of each shaft housing to the basis of the rotor. The feed material is then redirected obliquely through a pair of second feed zones 102, 104. Each second feed zone includes rotating feed plates 118 having bars 120 and grooves 122 carried by the base 42 of the rotor, stationary feed plates 124 having bars 126 and grooves 128 carried by the rotor housing 18 or its associated holder plates. The plates 118, 124 are juxtaposed to define a feed gap 130 which narrows from the first feed zone 96 to the refining zone 46 whereby the second feed zone 104 receives feed material from the first feed zones 96, breaks down the size of the feed material in the feed gap 130 without generation of steam, and advances the size-reduced feed material into the left 44 and right 46 frustroconical refining zones of the rotor under the influence of the centrifical force of the spinning rotor. These refining zones 46 include rotating refiner plates 50 having bars 52 and grooves 54 carried by the rotor 20, and stationary refining plates 58 having bars 60 and grooves 62 carried by the rotor housing 18 or associated plate holders 21. The plates 50, 58 are juxtaposed to define left and right frustroconical refining gaps 66 along which the material is defibrated with the release of steam. The material in the left and right refining zones flows towards the common major diameter 34 of the rotor 20, where it is captured in a casing and discharged from the refiner unit.

Although the preferred embodiment as shown in FIGS. 1 and 2 combines all the advantageous features of the invention, certain novel subfeatures of the invention are also noteworthy. For example, the rotor assembly preferably comprises two substantially identical frustroconical members 22, 24, each having a base 140, 142 closing one end 26, 30 of the member and a side wall 144, 146 defining a conical outer surface 36, 38 of increasing diameter from the base to the other end 28, 32 of the member. The other, larger end 28, 32 includes an annular face 148, 150 surrounding a hollow region 152, 154 formed by the side walls and the base. Means are provided for connecting the annular faces 148, 150 of the frustroconical members together to form a rotor shell 20 that has an enclosed cavity, the shell and cavity being symmetric about the rotation axis 16 and about the vertical plane 160 that passes in parallel between the annular faces. The conical outer surfaces 38 of the rotor shell 20 carry refiner plates 50 having bars 52 and grooves 54. The rotor assembly also includes left and right shaft segments 66, 68, each shaft segment having an inner end 70, 72 connected to the rotor shell, and an outer end 74, 76 adapted to be journalled and/or driven for rotation in a refiner unit.

In this manner a twin conical refiner rotor can easily be fabricated and assembled, while reducing the weight as a result of the hollow cavity enclosed within the completed rotor 20. The reduced weight of the rotor reduces the materials stress, and the motor size required to attain the desired rotation speed.

In another noteworthy feature, the steam profile control technique can be implemented in other types of conical or semi-conical refiners. Although the full advantages may not be achievable in other contexts, improvements relative to the current state of the art nevertheless can be significant, in terms of fiber quality control. In effect, any high consistency refiner having one feed or refining zone followed by an inclined refining zone, can be modified beneficially in accordance with the teachings disclosed and claimed with respect to FIG. 2 herein. The improvement relative to known refiners having radial and conical refining zones can be characterized by the bars 52, 60, grooves 54, 62 and gap 66 in the frustroconical refining zone 46 acting on the material with relatively low refining intensity and high refining power, whereby a steam pressure profile is established along the frustroconical refining zone 46. The pressure profile defines the pressure at which the radial gap corresponding to gap 130 in FIG. 2 communicates with the frustroconical gap 66 to admit a backflow of steam and the pressure at which the mixture of refined pulp and steam emerges with a forward flow of steam from the frustroconical gap 66 at the apex 34. The bars 120, 126, grooves 122, 128 and gap 130 in the radial zone corresponding to zone 104 in FIG. 2, act on the material with relatively high refining intensity at lower refining power, so as to reduce the size of the material and outwardly convey the material by centrifical force into the frustroconical refining zone 46, against the backflowing steam, without generating steam in the zone 104. The axial feed screw 84 is mounted for rotation within the shaft housing 14, at the same rotation speed as the rotor 20, and is shaped so that the feed material is conveyed along the inside wall 100 of the shaft housing while establishing an open channel 168 between the feed material and the shaft 68 for conveying backflowing steam from the radial zone 104.

First pressure control means 136, are established in fluid communication 112 with the backflow channel 168 through the shaft housing 14, for removing the backflowing steam from refiner at a controlled pressure. Second pressure control means 138, are provided for controlling the pressure at which the refined mixture is discharged at 116, from the casing 114. In this manner, the quality of the fiber obtained from the refiner can be controlled by the effect of the first 136 and second 138 control means, on the pressure profile in the frustroconical refining zone 46. This control is preferably further adjustable by third control means 170, for adjusting the difference in the refining power imposed on the material in the zones 46, 104 by adjusting at least one of the gaps 66 or 130. It should be appreciated that the second control means 138 shown at the discharge 116 of casing 114 can alternatively be provided at the discharge of a cyclone or other steam separator that is connected to the discharge 116.

We claim:

1. A refiner (10) for high yield, high consistency mechanical pulping of cellulosic feed material, comprising:

substantially tubular left (12) and right shaft housings (14) disposed about a common longitudinal axis (16);

a rotor housing (18) situated between and connected to the left and right shaft housings;

a twin conical rotor (20) situated within the rotor housing (18) for rotation about said longitudinal axis, said rotor having, left and right conical portions (22,24), each portion having a minor diameter end (26,30) and a major diameter end (28,32), the major diameter ends being substantially congruent to define the rotor apex (34), and the minor diameter ends being remote from each other, left and right inclined surfaces (36,38) extending toward each other obliquely to the axis from the minor toward the major diameters of the left and right conical portions, respectively, left and right base portions (40,42) at the respective minor diameter ends, each base portion extending respectively from the left and right inclined surfaces (36,38) toward the axis, left and right frustroconical refining zones (44,46) defined between the left inclined surface and the rotor housing, and between the right inclined surface and the rotor housing, respectively, each refining zone including, rotating refiner plates (48,50) having bars (52) and grooves (54) carried by the inclined surfaces of the rotor, stationary refining plates (56,58) having bars (60) and grooves (62) carried by the rotor housing (18), the plates (50,58) being juxtaposed to define left and right frustroconical refining gaps (64,66) along which cellulosic material is defibrated with the release of steam, whereby the material in the left refining zone and the material in the right refining zone flow toward the apex (34) of the rotor;

left and right shaft segments (66,68) situated coaxially within the left and right shaft housings, respectively, each shaft segment having an inner end (70,72) connected to the base portion of a rotor conical portion, an outer end (74,76) journalled for rotation within the shaft housing, and a shank (78,80) extending between the inner and outer ends of the shaft segment;

a ribbon feed screw (82,84) secured to the shank (78,80) of each shaft segment for co-rotation therewith;

first means (86,88; 90,92) penetrating the shaft housing, for supplying feed material to each feed screw, such that the feedscrews advance the feed material axially through a first feed zone (94,96) along the inside wall (98,100) of the shaft housing to the base portions (40,42) of the rotor;

means (102,104) defining a second feed zone at the base portion of each rotor, for receiving feed material from the first feed zone and advancing the feed material into the refining zones, while permitting a backflow of steam from the refining zones to the ribbon screws in the first feed zones;

second means (106,108; 110,112) penetrating the shaft housing, for withdrawing the backflow steam from the ribbon screws;

a casing (114) surrounding the rotor housing, for capturing the mixture of refined pulp and steam emerging from the refining zone at the apex of the rotor, and discharging (116) the mixture under pressure from the refiner.

2. The refiner of claim 1, wherein the inclined surfaces (38) of the rotor each form an acute angle with the axis, of less than 45 degrees, and the base portions (42) of the rotor each form an acute angle with the axis, of more than 45 degrees.

3. The refiner of claim 1, wherein the means (104) defining a second feed zone include, rotating feed plates (118) having bars (120) and grooves (122) carried by the base portion (42) of the rotor, stationary feed plates (124) having bars (126) and grooves (128) carried by the rotor housing, the plates being juxtaposed to define a feed gap (130) which narrows from the first feed zone (96) to the refining zone (46), whereby the feed material is reduced in size by the feed plates (118, 124) without generating steam, as the material moves through the feed gap (130) toward the refining zone (46) under the influence of centrifugal force.

4. The refiner of claim 1, wherein the first feed zone (96) includes a plurality of spaced apart blades (126) at the connection of the inner end (72) of each shaft to the base portion (42) of the rotor, whereby any feed material in the backflow steam is directed by the blades into the second feed zone (104).

5. The refiner of claim 3, wherein the refining gap (66) of each refining zone forms an acute angle with the axis, of less than 45 degrees, and the feed gap (130) of each second feed zone (104) forms an acute angle with the axis, of more than 45 degrees.

6. The refiner of claim 5, wherein the feed gap (130) of the second feed zone (104), forms an acute angle with the axis, which decreases along the feed gap such that the angle of the feed gap where the material passes (132) from the feed gap to the refining zone, is within 20 degrees of the acute angle formed by the refining (66) gap with the axis.

7. The refiner of claim 1, including, first pressure control means (134,136), associated with the second means penetrating the shaft housing (106,110), for controlling the pressure at which the backflow is withdrawn from the ribbon screw; and second pressure control means (138), for controlling the pressure at which said mixture is discharged (116) from the casing (114).

8. The refiner of claim 3, wherein the first feed zone (96) includes a plurality of spaced apart blades (126) at the connection of the inner end (72) of each shaft to the base portion (42) of the rotor, whereby any feed material in the backflow steam is directed by the blades into the second feed zone.

9. The refiner of claim 8, wherein the feed gap (130) of the second feed zone (104), forms an acute angle with the axis, which decreases along the feed gap such that the angle of the feed gap where the material passes (132) from the feed gap to the refining zone, is within 20 degrees of the acute angle formed by the refining gap with the axis.

10. The refiner of claim 8, including, first pressure control means (134,136), associated with the second means penetrating the shaft housing (106,110), for controlling the pressure at which the backflow is withdrawn from the ribbon screw; and second pressure control means (138), for controlling the pressure at which said mixture is discharged (116) from the casing (114).

11. The refiner of claim 3, wherein the length of the refining gap (66) in the refining zone (46) is at least about 50 per cent greater than the length of the feed gap (130) in the second feed zone (104).

12. The refiner of claim 3, wherein the feed gap (130) in the second feed zone (104) forms an acute angle with the axis, of less than 80 degrees.

13. The refiner of claim 1, wherein each conical portion (22,24) is a substantially identical, bowl-shaped unitary member with a base wall (140,142) defining the minor diameter end connected to the shaft, a side wall (144,146) defining said inclined surface and an annular face (148,150) at said major diameter end, and a hollow central region (152,154), and means (156,158) are provided for connecting the annular faces of the left and right conical portions together to form a rotor that is symmetric about a vertical plane (160) that passes in parallel between the annular faces.

14. The refiner of claim 13, wherein the means for connecting the annular faces include bores (156) passing axially from the base end (42) to the face of the left (right) conical portion, and fastener means situated partially in the bores of the left (right) conical portion and engaged with the face of the right (left) conical portion.

15. A refiner (10) for high yield, high consistency mechanical pulping of cellulosic feed material, comprising:

substantially tubular left (12) and right (14) shaft housings disposed about a common longitudinal axis (16);

a rotor housing (18) situated between and connected to the left and right shaft housings;

a rotor (20) situated within the rotor housing for rotation about said longitudinal axis, said rotor having a major diameter (34) which lies in a plane of symmetry (160) extending perpendicularly to the axis midway between axially spaced apart left (26) and right ends (30);

left (44) and right (46) frustroconical refining zones defined between the left end (26) and major diameter (34) of the rotor, and the right end (30) and major diameter of the rotor (34), respectively, each refining zone including, rotating refiner plates (48,50) having bars (52) and grooves (54) carried by the the rotor, stationary refining plates (56,58) having bars (60) and grooves (62) carried by the rotor housing (18), the plates (50,58) being juxtaposed to define left and right frustroconical refining gaps (64,66) along which cellulosic material is defibrated with the release of steam, whereby the material in the left refining zone (44) and the material in the right refining zone (46) flow as a mixture of pulp and steam toward the major diameter (34) of the rotor;

left and right shaft segments (66,68) situated coaxially within the left and right shaft housings, respectively, each shaft segment having an inner end (70,72) connected to the rotor, an outer end (74,76) journalled for rotation within the shaft housing, and a shank (78,80) extending between the inner and outer ends of the shaft segment;

feed screw means (82,84) coaxially situated between the shank (78,80) of each shaft segment and the shaft housing (12,14), for conveying feed material axially inwardly in a first feed zone (94,96) to each end of the rotor;

first means (86,88; 90,92) penetrating the shaft housing, for supplying feed material to each feed screw;

a second feed zone (102,104) at each end of the rotor, including, rotating feed plates (118) having bars (120) and grooves (122) carried at the ends (26,30) of the rotor, stationary feed plates (124) having bars (126) and grooves (128) carried by the rotor housing, the plates being juxtaposed to define a feed gap (130) which narrows from the first feed zone (96) to the refining zone (46), whereby the second feed zones (102,104) receive feed material from the first feed zones (94,96), break down the size of the feed material in said feed gaps (130) without generation of steam, and advance the size-reduced feed material into the refining zones (46) under the influence of centrifugal force;

a casing (114) surrounding the rotor housing (18), for capturing the mixture of refined pulp and steam emerging from the refining zone (46) at the major diameter (34) of the rotor, and discharging (116) the mixture from the refiner.

16. The refiner of claim 15, wherein the the refining gap (66) forms an acute angle with the axis (16), of less than 45 degrees, and the feed gap (130) of the second feed zone (104) forms an acute angle with the axis, of more than 45 degrees.

17. The refiner of claim 16, wherein the feed gap (130) forms an angle of less than about 80 degrees.

18. The refiner of claim 15, wherein the refining gap (66) forms an acute angle with the axis (16), of less than about 45 degrees, and the feed gap (130) of the second feed zone (104), forms an acute angle with the axis (16), which decreases along the feed gap such that the angle of the feed gap where the material passes from the feed gap to the refining zone (46), is within 20 degrees of the acute angle formed by the refining gap with the axis.

19. The refiner of claim 15, wherein the feed screw means is a ribbon screw (82, 84) which rotates at the same speed as the rotor.

20. The refiner of claim 15, wherein the gaps (64,66) and bars (52,60) in the refining zones (44,46) defibrate the material with low intensity and high power, whereas the gaps (130) and bars (118,126) in the second feed zone break down the size of the material with high intensity and low power.

21. The refiner of claim 15, wherein the refining zones (44,46) have at least about twice as many bars (52,60) as the number of bars (118,126) in the second feed zones (104).

22. The refiner of claim 21, wherein the minimum feed gap (130) in the second feed zone (104) is at least about five times greater than the average gap (66) in the refining zone (44,46).

23. The refiner of claim 15, wherein the length of the refining gap (130) is at least about 50 per cent greater than the length of the feed gap (130) in the second feed zone (104).

24. In an apparatus (10) for the high consistency mechanical refining of cellulosic feed material, said apparatus having a substantially tubular shaft housing (14) disposed about a longitudinal axis (16); a rotatable shaft (68) coaxially located within the shaft housing; a rotor housing (18) connected to the shaft housing; a rotor (20) situated within the rotor housing for rotation about said longitudinal axis, said rotor having a smaller diameter base (42) connected to the shaft (68) and a larger diameter apex (34) axially offset from the base; a frustroconical refining zone (46) located between the apex and the base and a radial refining zone (104) extending substantially radially along the base, the frustroconical refining zone (46) including rotating refiner plates (50) having bars (52) and grooves (54) carried by the the rotor (20) and stationary refining plates (58) having bars (60) and grooves (62) carried by the rotor housing (18), the plates being juxtaposed to define a frustroconical refining gap (66), and the substantially radial refining zone (104) including rotating refiner plates (118) having bars (120) and grooves (122) carried by the rotor (20) and stationary refining plates (124) having bars (126) and grooves (128) carried by the rotor housing (18), the plates (118, 124) being juxtaposed to define a substantially radial refining gap (130), said radial gap (130) being in fluid communication with said frustroconical gap (66) such that material entering the radial gap (130) moves outwardly through the gaps (130,66) sequentially under the influence of centrifugal force and is refined with the release of steam whereby the refined material flows as a mixture of pulp and steam toward the apex (34) of the rotor; feed screw means (84) coaxially situated between the shaft (68) and the shaft housing (14), for conveying feed material axially inwardly to the base (42) of the rotor; first means penetrating the shaft housing (90,92), for supplying feed material under pressure to the feed screw; means (164) for conveying the feed material from the base of the rotor to the radial refining zone (104); and a casing (114) surrounding the rotor housing (18), for capturing the mixture of refined pulp and steam emerging from the refining zone (46) at the apex (34) of the rotor, and discharging (116) the mixture from the refiner, wherein the improvement comprises:

the bars (52,60), grooves (54,62) and gap (66) in the frustroconical refining zone (46) act on the material with relatively low refining intensity at high refining power to release steam, whereby a steam pressure profile is established along the frustroconical refining zone (46), said profile defining the pressure at which the radial gap (130) communicates with the frustroconical gap (66) to admit a backflow of steam and the pressure at which said mixture emerges with a forward flow of steam from the frustroconical gap (66) at the apex (34);

the bars (120,126), grooves (122,128) and gap (130) in the radial refining zone (104) act on the material with relatively high refining intensity at low refining power so as to reduce the size of the material and outwardly convey the material by centrifugal force into the frustroconical refining zone (46) against the backflowing steam, without generating steam in the radial refining zone (104);

said feed screw means (84) being mounted for rotation within the shaft housing (14) at the same rotation speed as the rotor (20), and shaped so that the feed material is conveyed along the inside wall (100) of the shaft housing while establishing an open channel (166) between the feed material and the shaft (68) for conveying backflowing steam from the radial refining zone (104);

first pressure control means (136), in fluid communication (112) with said channel (166) through the shaft housing (14), for removing the backflowing steam from the refiner at a controlled pressure; and second pressure control means (138), for controlling the pressure at which said mixture is discharged (116) from the casing (114);

whereby the quality of the fiber obtained from the refiner can be controlled by the effect of the first (136) and second (138) control means, on the pressure profile in the frustroconical refining zone (46).

25. The refiner of claim 24, including third control means (168), for adjusting the difference in the refining power imposed on the material in the frustroconical (46) and radial refining zones (104), by adjusting at least one of the frustroconical refining gap (66) and the radial refining gap (130).

26. The refiner of claim 24, wherein the refining intensity in the radial refining zone (104) is at least about fifty times the refining intensity in the frustroconical zone;

the refining power in the radial zone is less than about ten per cent of the refining power in the frustroconical zone.

27. The refiner of claim 26, wherein the retention time of the material in the radial refining zone is less than about three per cent of the retention time of the material in the frustroconical zone.

28. An apparatus (10) for the high consistency mechanical refining of cellulosic feed material, comprising:

a substantially tubular shaft housing (14) disposed about a longitudinal axis (16);

a rotatable shaft (68) coaxially located within the shaft housing;

a rotor housing (18) connected to the shaft housing;

a rotor (20) situated within the rotor housing for rotation about said longitudinal axis, said rotor having a smaller diameter base (42) connected to the shaft (68) and a larger diameter apex (34) axially offset from the base;

an inclined refining zone (46) located between the apex and the base and a hybrid zone (104) extending transversely to the axis (16) along the base;

the inclined refining zone (46) including rotating refining plates (50) having bars (52) and grooves (54) carried by the the rotor (20) and stationary refining plates (58) having bars (60) and grooves (62) carried by the rotor housing (18), the refining plates being juxtaposed to define a refining zone gap (66);

the hybrid zone (104) including rotating breaker plates (118) having bars (120) and grooves (122) carried by the rotor (20) and stationary breaker plates (124) having bars (126) and grooves (128) carried by the rotor housing (18), the breaker plates (118,124) being juxtaposed to define a hybrid zone gap (130) in fluid communication with said refining zone gap (66);

feed means (84) coaxially situated between the shaft (68) and the shaft housing (14), for conveying feed material axially inwardly toward the base (42) of the rotor and into the hybrid zone (104);

whereby material entering the hybrid zone gap (130) moves outwardly through the gaps (130,66) sequentially under the influence of centrifugal force and is refined with the release of steam whereby the refined material flows as a mixture of pulp and steam toward the apex (34) of the rotor;

a casing (114) surrounding the rotor housing (18), for capturing the mixture of refined pulp and steam emerging from the refining zone (46) at the apex (34) of the rotor, and discharging (116) the mixture from the refiner;

wherein the bars (52,60), grooves (54,62) and gap (66) in the inclined refining zone (46) act on the material with relatively low refining intensity at high refining power to release steam and establish a steam pressure profile along the inclined refining zone (46), said profile defining the pressure at which the hybrid zone gap (130) communicates with the refining zone gap (66) to admit a backflow of steam and the pressure at which said mixture emerges with a forward flow of steam from the refining zone gap (66) at the apex (34);

wherein the bars (120,126), grooves (122,128) and gap (130) in the hybrid zone (104) act on the material with relatively high refining intensity at low refining power so as to reduce the size of the material and outwardly convey the material by centrifugal force into the refining zone (46) against the backflowing steam;

wherein the refining intensity in the hybrid zone (104) is at least about fifty times the refining intensity in the refining zone (46) and the refining power in the hybrid zone is less than about ten per cent of the refining power in the refining zone.

29. The apparatus of claim 28, wherein the refining zone gap and the hybrid zone gap have respective lengths and the length of the refining zone gap is at least about 50 per cent greater than the length of the hybrid zone gap.

30. The apparatus of claim 28, wherein the refining zone gap (66) and the hybrid zone gap (130) have respective widths, and the minimum hybrid zone gap width is at least about five times the refining zone gap average width.

31. The apparatus of claim 28, wherein the density of bars (52,60) in the refining zone (46) is at least about four times the density of bars (120,126) in the hybrid zone (104).

32. The apparatus of claim 28, wherein the refining zone and the hybrid zone have respective lengths and the length of the refining zone gap (66) is at least about 50 per cent greater than the length of the hybrid zone gap (130);

the refining zone gap (66) and the hybrid zone gap (130) have respective widths, and the minimum hybrid zone gap width is at least about five times the refining zone gap average width; and the density of bars (52,60) in the refining zone (46) is at least about four times the density of bars (120,126) in the hybrid zone (104).

33. The apparatus of claim 28, wherein said feed means (84) is a screw mounted for rotation within the shaft housing (14) at the same rotation speed as the rotor (20), and shaped so that the feed material is conveyed along the inside wall (100) of the shaft housing while establishing an open channel (166) between the feed material and the shaft (68) for conveying backflowing steam from the hybrid zone (104);

first pressure control means (136), are provided in fluid communication (112) with said channel (166) through the shaft housing (14), for removing the backflowing steam from the refiner at a controlled pressure; and second pressure control means (138), are provided for controlling the pressure at which said mixture is discharged (116) from the casing (114);

whereby the quality of the fiber obtained from the refiner can be controlled by the effect of the first (136) and second (138) control means, on the pressure profile in the frustroconical refining zone (46).

34. A rotor assembly for rotation about a rotation axis (16) in a high consistency mechanical pulp refiner (10), comprising:

two substantially identical frustroconical members (22,24), each having a base (140,142) closing one end (26,30) of the member, a side wall (144,146) defining a conical outer surface (36,38) of increasing diameter from the base to the other end (28,32) of the member, said other end including an annular face (148,150) surrounding a hollow region (152,154) formed by said side wall and said base;

means (156,158) for connecting the annular faces (148,150) of the frustroconical members together to form a rotor shell (20) that has an enclosed cavity, the shell and cavity being symmetric about said rotation (16) axis and about a vertical plane (160) that passes in parallel between the annular faces;

refiner plates (50) having bars (52) and grooves (54) carried by the conical outer surface (38) of the rotor shell (20); and left and right shaft segments (66,68), each shaft segment having an inner end (70,72) connected to the rotor shell (20), and an outer end (74,76) adapted to be journalled for rotation in the refiner.

35. The rotor assembly of claim 34, wherein the base at each end of the rotor shell carries breaker plates (118) having bars (120) and grooves (122).

36. The rotor assembly of claim 35, wherein the bars (120) and grooves (122) form acute angles relative to the rotation axis (16), which become more acute along the direction from the base toward the refiner plates (50).

37. The rotor assembly of claim 35, wherein the length of the bars (52) and grooves (54) on the refiner plates (50) are greater than the lengths of the bars (120) and grooves (122) on the breaker plate (118) by at least about 50 per cent.

38. The rotor assembly of claim 37, wherein the number of bars (52) on the refiner plates (50) is at least twice the number of bars on the breaker plates (118).

39. A method for the high consistency mechanical refining of cellulosic material in a refining zone (46) defined between a rotor surface (138) and a stator surface (162), comprising:

driving left and right shaft segments (66,68) within substantially tubular left and right shaft housings (12,14) disposed about a common longitudinal axis (16), so as to spin a rotor (20) connected between the shaft segments and situated within a rotor housing (18) connected between the left and right shaft housings, said rotor having a major diameter (34) which lies in a plane of symmetry (160) extending perpendicularly to the axis midway between axially spaced apart left and right rotor ends (26,30), conveying feed material axially inwardly in a first feed zone (94,96) along the inner wall (98,100) of each shaft housing to the rotor;

conveying the feed material through a second feed zone (102,104) at each end of the rotor, the second feed zone including, rotating feed plates (118) having bars (120) and grooves (122) carried at the ends (30) of the rotor, stationary feed plates (124) having bars (126) and grooves (128) carried by the rotor housing (18), the plates (118,124) being juxtaposed to define a feed gap (130) which narrows from the first feed zone (96) to the refining zone (46), whereby the second feed zones (104) receive feed material from the first feed zones (96), break down the size of the feed material in said feed gaps (130) without generation of steam, and advance the size-reduced feed material into the refining zones (46) under the influence of the centrifugal force of the spinning rotor;

conveying the material of reduced size into left (44) and right frustroconical refining zones (46) defined between the left end (26) and major diameter (34) of the rotor, and the right end (30) and major diameter of the rotor (34), respectively, each refining zone (46) including rotating refiner plates (50) having bars (52) and grooves (54) carried by the the rotor (20), stationary refining plates having bars (60) and grooves (62) carried by the rotor housing (18), the plates (50,58) being juxtaposed to define left and right frustroconical refining gaps (66) along which cellulosic material is defibrated with the release of steam, whereby the material in the left refining zone (44) and the material in the right refining zone (46) flow toward the major diameter (34) of the rotor (20);

capturing the mixture of refined pulp and steam emerging from the refining zone (44,46) at the major diameter of the rotor in a casing (114) surrounding the rotor housing (18), and discharging (116) the mixture from the refiner.

40. The method of claim 39, wherein, the material in the second feed zones (102,104) is broken down with relatively high intensity and low power, and the material in the refining zones (44,46) is defibrated with relatively low intensity and high power.

41. The method of claim 39, further including the steps of withdrawing from the refiner at a controlled pressure, backflow steam that has passed from the refining zone through the second feed zone.

42. The method of claim 41, including the step of controlling selected properties of the fiber discharged from the casing, by adjusting the difference between the casing discharge pressure and the pressure at which the backflow steam is withdrawn.

* * * * *